US009075354B2

(12) United States Patent
Proffitt et al.

(10) Patent No.: US 9,075,354 B2
(45) **Date of Patent: *Jul. 7, 2015**

(54) SELF LUBRICATING FUSER AND METHOD OF OPERATION

(71) Applicant: Lexmark International, Inc., Lexington, KY (US)

(72) Inventors: Donald Eugene Proffitt, Richmond, KY (US); Fangsheng Wu, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 37 days.

This patent is subject to a terminal disclaimer.

(21) Appl. No.: 13/777,963

(22) Filed: Feb. 26, 2013

(65) Prior Publication Data

US 2014/0241748 A1 Aug. 28, 2014

(51) Int. Cl.
*G03G 15/20* (2006.01)

(52) U.S. Cl.
CPC ..... *G03G 15/2025* (2013.01); *G03G 15/2075* (2013.01); *G03G 2215/0145* (2013.01)

(58) Field of Classification Search
CPC ..... G03G 15/2075
USPC ..... 399/329; 184/6.1
See application file for complete search history.

(56) References Cited

U.S. PATENT DOCUMENTS

| | | | | |
|---|---|---|---|---|
| 4,040,383 | A | 8/1977 | Vandervort | |
| 4,309,957 | A | 1/1982 | Swift | |
| 4,870,445 | A | 9/1989 | Collier et al. | |
| 4,870,446 | A * | 9/1989 | Bickerstaff et al. | 137/807 |
| 5,232,499 | A | 8/1993 | Kato et al. | |
| 5,465,810 | A | 11/1995 | Peterson et al. | |
| 5,620,060 | A * | 4/1997 | Bialke | 184/104.1 |
| 5,996,739 | A * | 12/1999 | Hoffmann | 184/7.4 |
| 7,027,763 | B2 * | 4/2006 | Kato et al. | 399/329 |
| 7,412,185 | B2 * | 8/2008 | Hall et al. | 399/88 |
| 2002/0015603 | A1 | 2/2002 | Kimura et al. | |
| 2012/0020708 | A1 | 1/2012 | Zess et al. | |
| 2014/0241763 | A1 | 8/2014 | Proffitt et al. | |

OTHER PUBLICATIONS

International Search Report and Written Opinion of the International Searching Authority for PCT application PCT/US2014/018399, Jun. 6, 2014.
U.S. Patent and Trademark Office, Final Office Action for U.S. Appl. No. 13/777,883 dated Oct. 2, 2014.

* cited by examiner

*Primary Examiner* — Clayton E Laballe
*Assistant Examiner* — Trevor J Bervik

(57) ABSTRACT

A belt fuser assembly which dispenses lubricant oil or other depleted lubricant component to the inner surface of the fuser belt. The belt fuser assembly may include a lubricant dispenser positioned to be heated by the heating element of the fuser assembly for dispensing a lubricant oil to the inner surface of the fuser belt. A controller coupled to the heating element activates the heating element to generate heat at a fusing temperature during a fusing operation and at at least one second temperature greater than the fusing temperature during a lubricant dispensing operation so as to cause lubricant to dispense from the lubricant dispenser.

20 Claims, 7 Drawing Sheets

SELF LUBRICATING FUSER AND METHOD OF OPERATION

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to a lubricant dispenser for a fuser assembly in an electrophotographic imaging device, such as a laser printer or multifunction device having printing capability.

2. Description of the Related Art

An image forming machine, such as a printer, copier, all-in-one device or multifunctional device, typically includes a heating device, such as a fuser, to fix a developing agent, such as toner, to a media sheet. The fuser typically contains a heater and an endless belt and backup pressure roll that form a nip for the media sheet to pass through. The heater and belt provide heat and/or pressure to the toner to soften the toner so that it will adhere to the media sheet. The fuser belt defines an inner loop. The heater is positioned within the inner loop in direct contact with the belt. The heater has a profile generally corresponding to the travel path of the belt to provide an area contact rather than a line contact for more efficient thermal transfer. The heater is typically in the form of a ceramic heater held in a heater housing positioned within the inner loop and against the belt. The fuser belt is an "idling belt" having no drive rolls within it. The belt is driven by the rotation of the backup pressure roll, through the driving association of the belt with the pressure roll at the nip.

An issue with today's fusers is that only a portion of the lubricant that is applied to the fuser components during manufacture is available over the life of the fuser for reducing the friction between the belt and the heater. Only a certain amount of lubricant can be kept in the system and any excess lubricant will be pushed out of the belt at the very early stages of fuser life. As the lubricant is contaminated or broken down chemically and mechanically, the friction between the belt and the heater increases, belt wear increases, thereby leading to even more friction and more wear, until the frictional forces between the paper and the belt are insufficient to drive the belt. When the paper can no longer drive the belt, a paper jam occurs.

At a top level view, the lubricant can be viewed as two separate parts: 1) filler, and 2) oil. The filler makes up the majority of the total initial lubrication applied during assembly (at least 80%) and is designed to retain the oil.

Small amounts of oil reduce and maintain a desired fuser drive torque over a specified timeframe. Over time, the oil is removed from the filler via evaporation and/or run-off and new oil is required to reduce and maintain low fuser drive torque. Testing has indicated that additional oil introduced to the belt assembly every predetermined number of pages, such as 50,000 pages, serves to maintain a desired fuser drive torque.

SUMMARY

Example embodiments of the present disclosure overcome the shortcomings of prior belt fuser assemblies and thereby satisfy a significant need for a fuser assembly having a lubricant dispensing mechanism. According to an example embodiment, there is shown a heat transfer member including a housing; a heating element within the housing, the heating element for heating, at a fusing temperature, a media sheet during fusing operations; a flexible belt having an inner surface contacting the heating element and an outer surface; and a lubricant dispenser positioned to be heated by the heating element for dispensing a lubricant, or oil thereof, to the flexible belt. The lubricant dispenser may include a reservoir containing the lubricant or lubricant oil and an exit port for delivering the lubricant from the reservoir to the inner surface of the flexible belt upon the reservoir being heated by the heating element at a temperature above the fusing temperature; and a backup member positioned to engage the outer surface of the flexible belt thereby defining a fusing nip.

In an example embodiment, when selectively heating the lubricant dispenser by the heat transfer member to a temperature that is greater than the fusing temperature of the fusing assembly, air and lubricant oil in the reservoir sufficiently expand to discharge lubricant oil from the lubricant dispenser. The lubricant oil is discharged from the exit port onto the inner surface of the flexible belt. In this way, lubricant oil may be discharged at selected times throughout the life of the fuser assembly, without the use of a pump or other mechanisms, so as to ensure desired levels of wear of the flexible belt therein.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
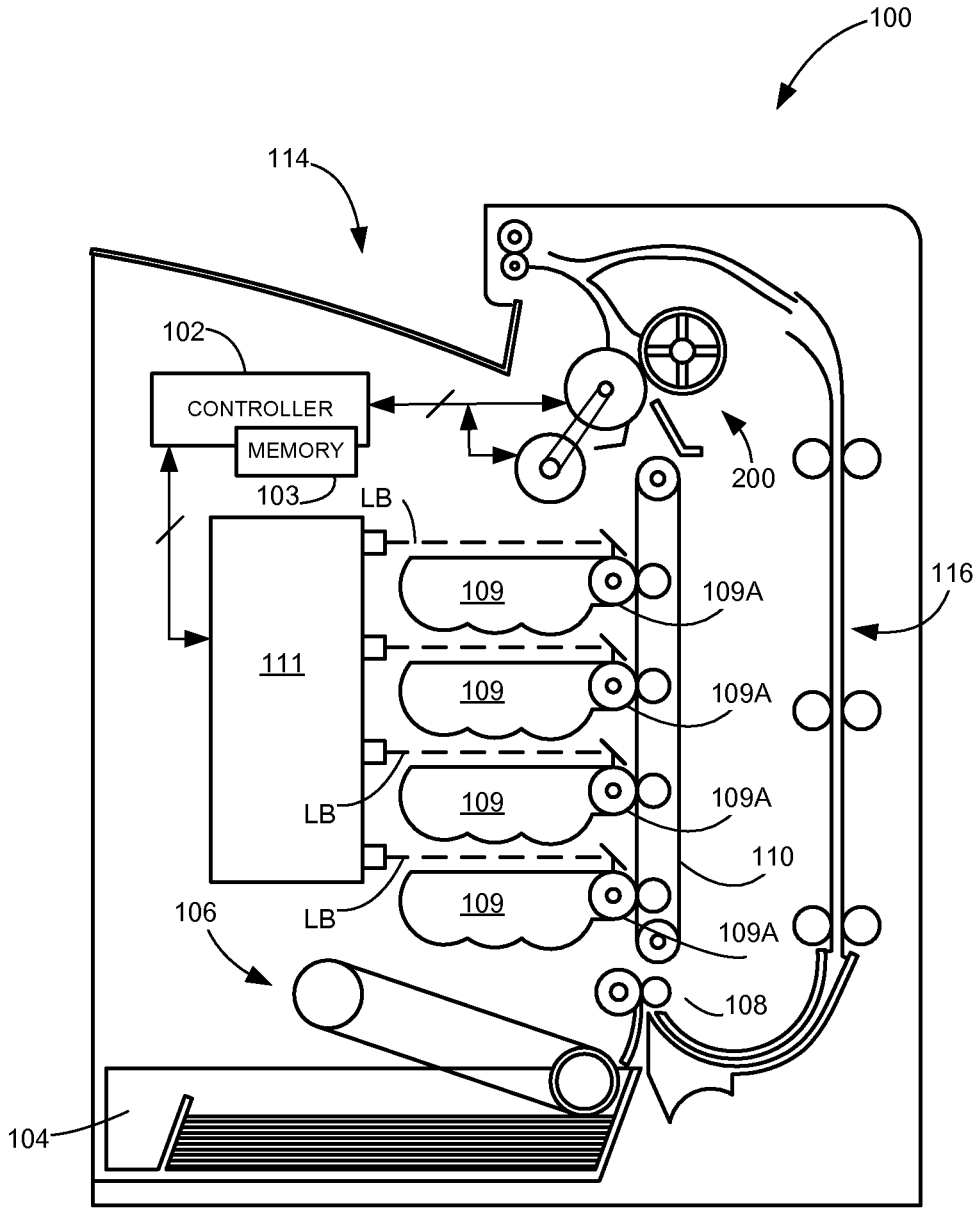
FIG. 1 is a side elevational view of an improved imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

Referring now to the drawings and particularly to FIG. 1, there is shown an imaging device in the form of a color laser printer, which is indicated generally by the reference numeral 100. An image to be printed is typically electronically transmitted to a processor or controller 102 by an external device (not shown) or the image may be stored in a memory 103 embedded in or associated with the controller 102. Memory 103 may be any volatile and/or non-volatile memory such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may include one or more processors and/or other logic necessary to control the functions involved in electrophotographic imaging by imaging device 100. Controller 102 may execute firmware stored in memory 103 for controlling imaging device 100 to perform, among other functions, electrophotographic imaging.

In performing a print operation, controller 102 initiates an imaging operation in which a top media sheet of a stack of media is picked up from a media or storage tray 104 by a pick mechanism 106 and is delivered to a media transport apparatus including a pair of aligning rollers 108 and a media transport belt 110 in the illustrated embodiment. The media transport belt 110 carries the media sheet along a media path past four image forming stations 109 which apply toner to the media sheet through cooperation with laser scan unit 111. Each imaging forming station 109 provides toner forming a distinct color image plane to the media sheet. Laser scan unit 111 emits modulated light beams LB, each of which forms a latent image on a photoconductive surface or drum 109A of the corresponding image forming station 109 based upon the bitmap image data of the corresponding color plane. The operation of laser scan units 111 and imaging forming stations 109 is known in the art such that a detailed description of their operation will not be provided for reasons of expediency.

Fuser assembly 200 is disposed downstream of image forming stations 109 and receives from media transport belt 110 media sheets with the unfused toner images superposed thereon. In general terms, fuser assembly 200 applies heat and pressure to the media sheets in order to fuse toner thereto. After leaving fuser assembly 200, a media sheet is either deposited into output media area 114 or enters duplex media path 116 for transport to the most upstream image forming station 109 for imaging on a second surface of the media sheet.

Imaging device 100 is depicted in FIG. 1 as a color laser printer in which toner is transferred to a media sheet in a single transfer step. Alternatively, imaging device 100 may be a color laser printer in which toner is transferred to a media sheet in a two-step process—from image forming stations 109 to an intermediate transfer member in a first step and from the intermediate transfer member to the media sheet in a second step. In another alternative embodiment, imaging device 100 may be a monochrome laser printer which utilizes only a single image forming station 109 for depositing black toner to media sheets. Further, imaging device 100 may be part of a multi-function product having, among other things, an image scanner for scanning printed sheets.

Figure 2:
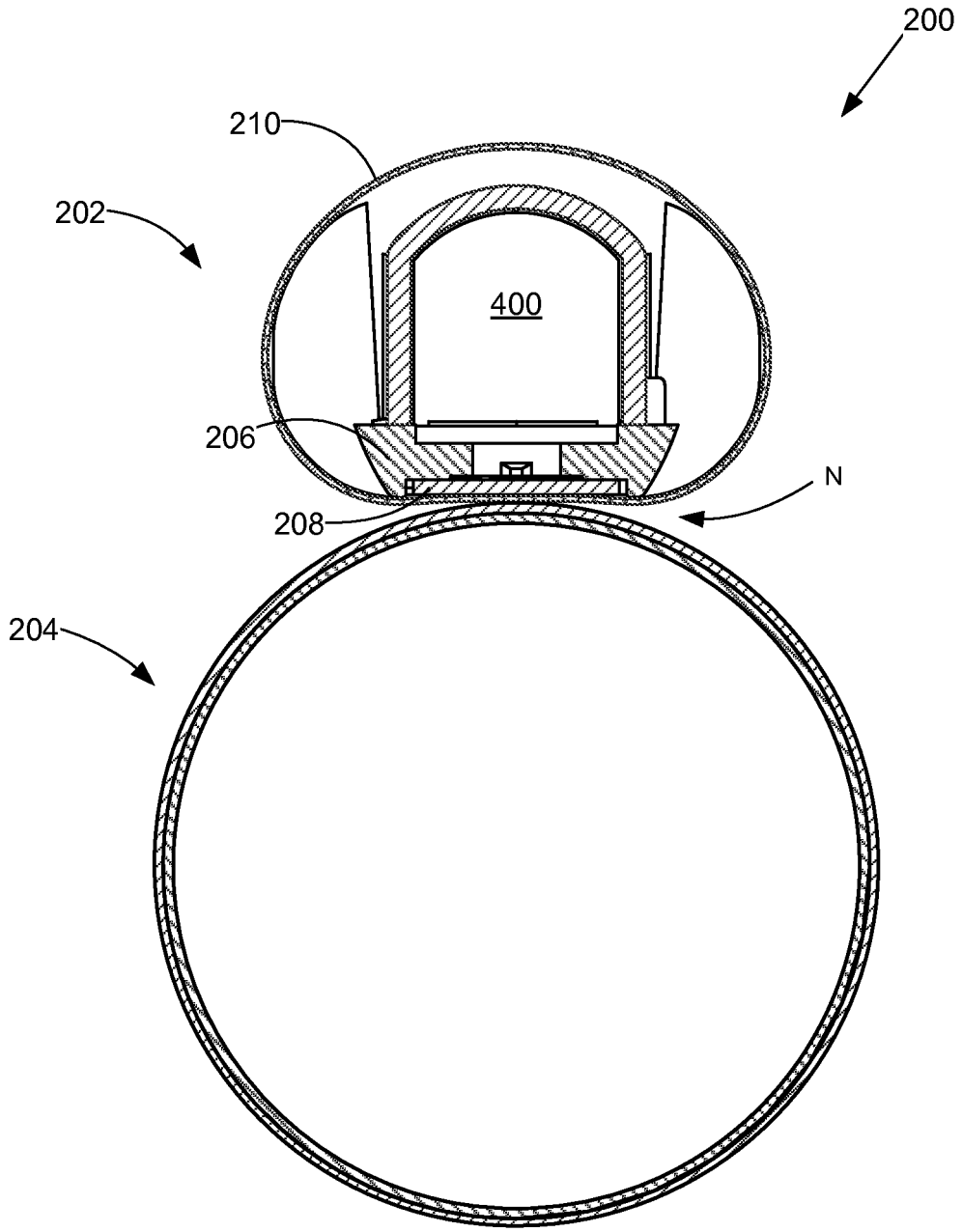
FIG. 2 is a cross sectional view of a fuser assembly of FIG. 1.

With respect to FIG. 2, fuser assembly 200 may include a heating apparatus 202 and a backup member 204 cooperating with the heating apparatus 202 to define a fuser nip N for conveying media sheets therein. The backup member 204 may include a backup roll. The heating apparatus 202 may include a housing 206, a heating element 208 supported on or at least partially in housing 206, and a moving member 210. The moving member 210, which in an example embodiment is an endless flexible belt, includes an inner surface in contact with the heating element 208, and an outer surface that engages with the backup member 204 to define the fuser nip N.

Heating element 208 may be formed from a substrate of ceramic or like material to which one or more resistive traces is secured which generates heat when a current is passed through the resistive traces. Heating element 208 may further include at least one temperature sensor (not shown), such as a thermistor, coupled to the substrate for detecting a temperature of heating element 208. It is understood that heating element 208 alternatively may be implemented using other heat generating mechanisms. Heating element 208 may be controlled by controller 102 to generate a desired amount of heat.

Moving member 210 may be formed as a flexible belt. Moving member 210 is disposed around housing 206 and heating element 208. Backup member 204 contacts moving member 210 such that moving member 210 rotates about housing 206 and heating element 208 in response to backup member 204 rotating. With moving member 210 rotating around housing 206 and heating element 208, the inner surface of moving member 210 contacts heating element 208 so as to heat moving member 210 to a temperature sufficient to perform a fusing operation to fuse toner onto sheets of media.

Figure 3:
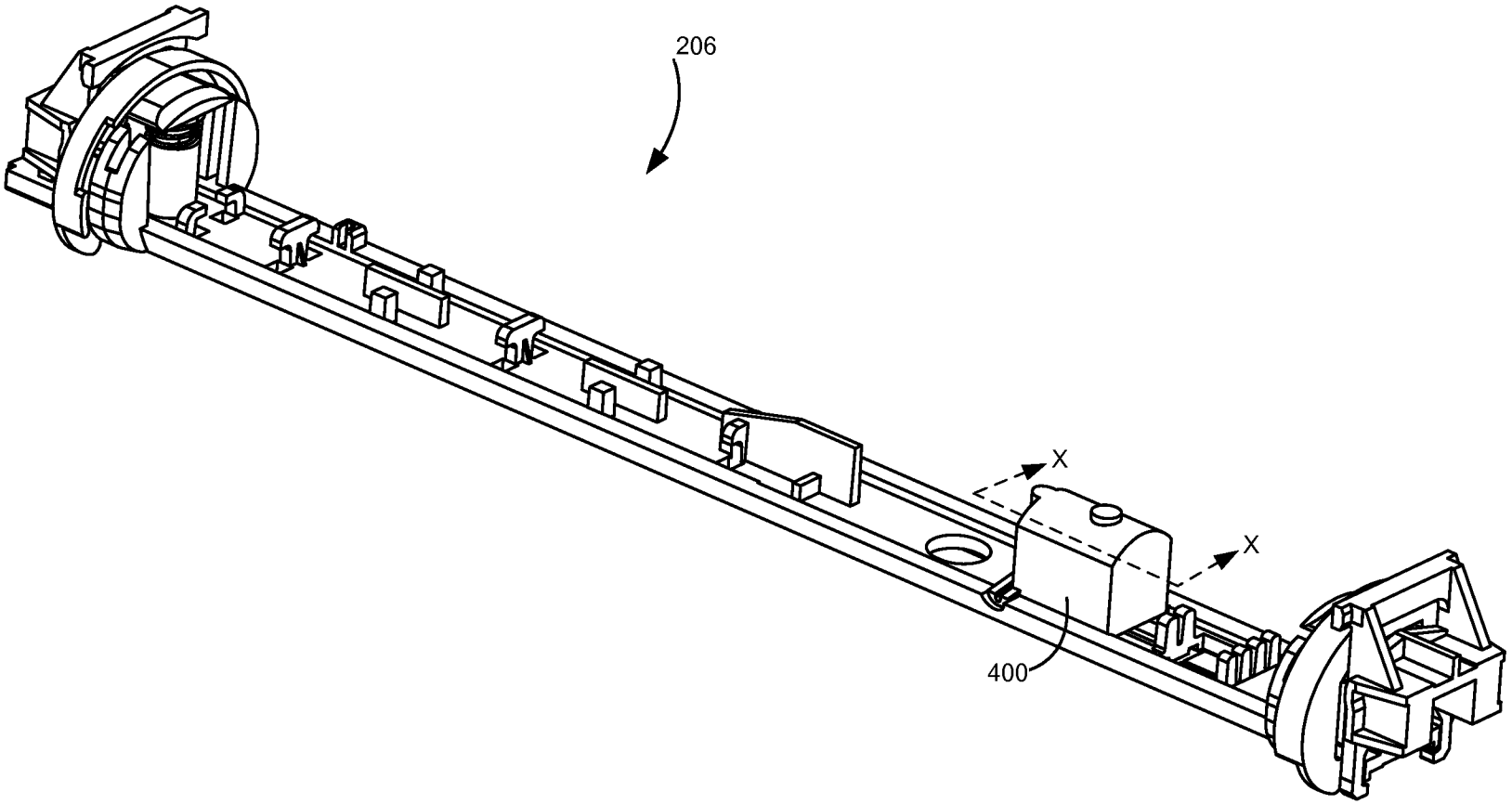
FIG. 3 is a perspective view of housing with a lubricant dispenser for a heating apparatus of FIG. 2.

The inner surface of the moving member 210 is coated with a lubricant to reduce friction between the moving member 210 and heating element 208. After a number of operations of the fuser assembly 200, the lubricant may be contaminated or broken down chemically or mechanically. To replenish the lubricant or lubricant component or portion thereof on the inner surface of the moving member 210 that may have been depleted due to evaporation, run off or the like, the heating apparatus 202 further includes a lubricant dispenser 400. As illustrated in FIGS. 2 and 3, the lubricant dispenser 400 is associated with the housing 206 in proximity with the heating element 208. With lubricant dispenser 400 being in close proximity to heating element 208, lubricant or component(s) thereof contained within lubricant dispenser 400 may be suitably heated thereby. In general terms, lubricant dispenser 400 is heated above fusing temperature by heating element 208 at selected times throughout the life of fuser assembly 200 and/or moving member 210 therein so as to discharge a sufficient amount of lubricant or lubricant component(s) to ensure desired wear levels of moving member 210.

Lubricant dispenser 400 is described hereinbelow for dispensing lubricant oil—the oil component of the lubricant—onto the inner surface of moving member 210 during the useful life thereof. It is understood, though, that lubricant dispenser 400 may dispense the lubricant in its entirety and/or any other component of the lubricant that needs to be replenished during the useful life of moving member 210.

Figure 4:
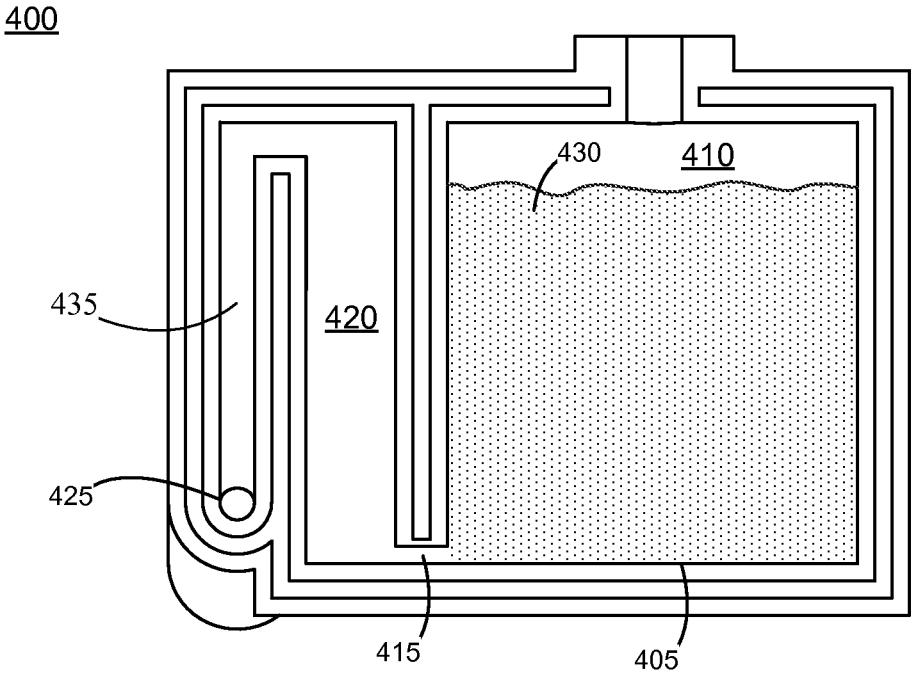
FIG. 4 is a cross sectional view of the lubricant dispenser along line X-X of FIG. 3.

FIG. 4 illustrates lubricant dispenser 400 in more detail. Lubricant dispenser 400 includes a reservoir 405 containing lubricant oil 430, and an exit port 425 for delivering lubricant oil 430 from reservoir 405 to the inner surface of moving member 210. Reservoir 405 includes a first chamber 410 and a second chamber 420 disposed adjacent the first chamber 410. In one example embodiment, first chamber 410 has a space volume larger than a space volume of second chamber 420, but it is understood that first chamber 410 may be of a different size relative to second chamber 420. For example, first chamber 410 may be substantially the same size or less in size relative to second chamber 420. First chamber 410 initially contains at least some of lubricant oil 430, such as a majority thereof. The reservoir 405 may contain lubricant oil 430 at an initial amount to occupy substantially equal or more than 50% of the volume of first chamber 410. Other than lubricant oil 430, the reservoir 405 may further contain air.

Reservoir 405 further includes a connecting passage 415 at the bottom portion thereof to connect first chamber 410 to second chamber 420. The connecting passage 415 allows lubricant oil 430 to flow between first chamber 410 and second chamber 420. Second chamber 420 is in fluid communication with exit port 425 of reservoir 405. In particular, exit port 425 is in fluid communication with a portion of the second chamber 420 that is spaced from a bottom portion of second chamber 420 where lubricant oil 430 may be disposed following transport through connecting passage 415. In one example embodiment, exit port 425 is disposed along a top portion of second chamber 420. In the example embodiment illustrated in FIGS. 4 and 5A-5C, exit port 425 is disposed along a lower portion of reservoir 405 but is in fluid communication with a top portion of second chamber 420 via second connecting passage 435. Exit port 425 directs the flow of lubricant oil 430 from second chamber 420 to the inner surface of the moving member 210.

Lubricant dispenser 400 operates upon application of heat to the reservoir 405 by the heating element 208. The lubricant dispenser 400 operates based on the expansion rates of air and lubricant oil 430 in reservoir 405, and the application of heat by heating element 208. Upon application of heat to the reservoir 405, the air and lubricant oil 430 inside the reservoir 405 expand. The heating element 208 provides heat at a first temperature during normal operation, e.g., during fusing operations. In an example embodiment, the first temperature may be about 160 degrees C. The expansion rates of air and lubricant oil 430, however, do not result in the discharge of lubricant oil 430 from reservoir 405 during fusing operations. It is only when reservoir 405 is heated at a second temperature, higher than the fusing temperature, which results in lubricant oil 430 being dispensed from lubricant dispenser 400 onto the inner surface of moving member 210. In an example embodiment, the second temperature may be 200 degrees C., but it is understood that the second temperature may be at any of a number of elevated temperatures relative to the first (fusing) temperature.

Figure 5A:
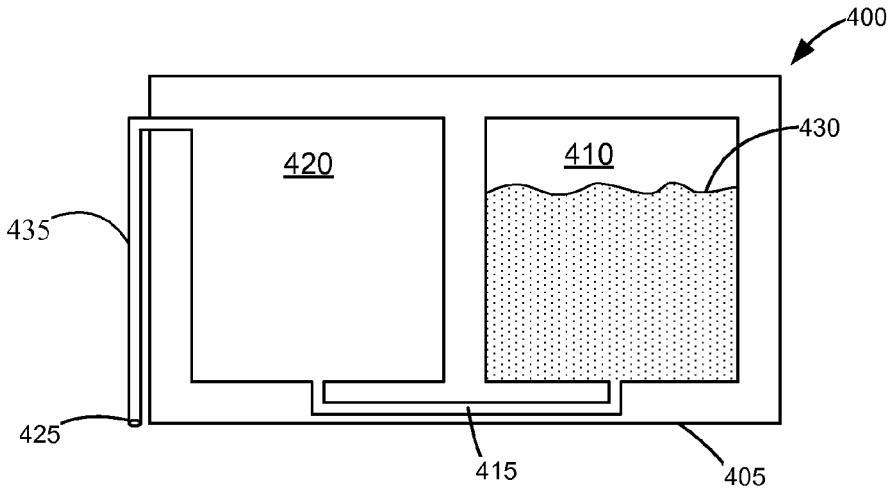
FIGS. 5A-5C are schematic views of the lubricant dispenser at different operating conditions.
Figure 5B:
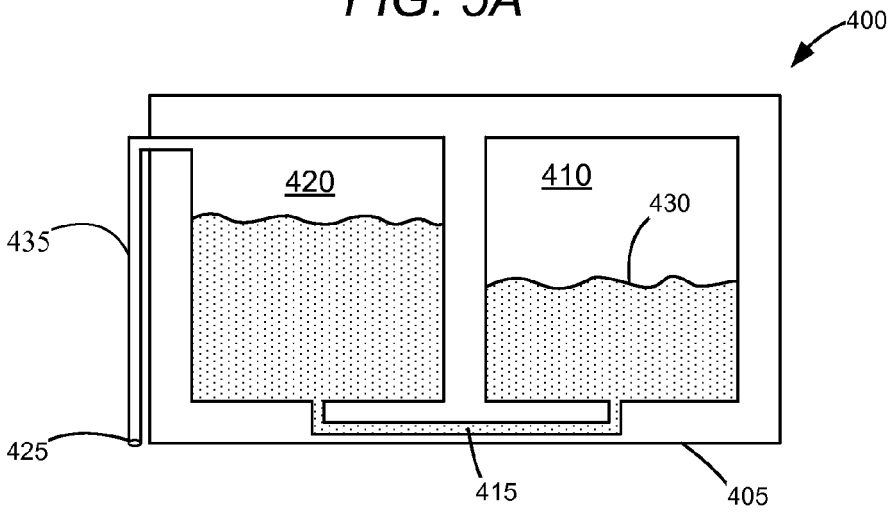
Figure 5C:
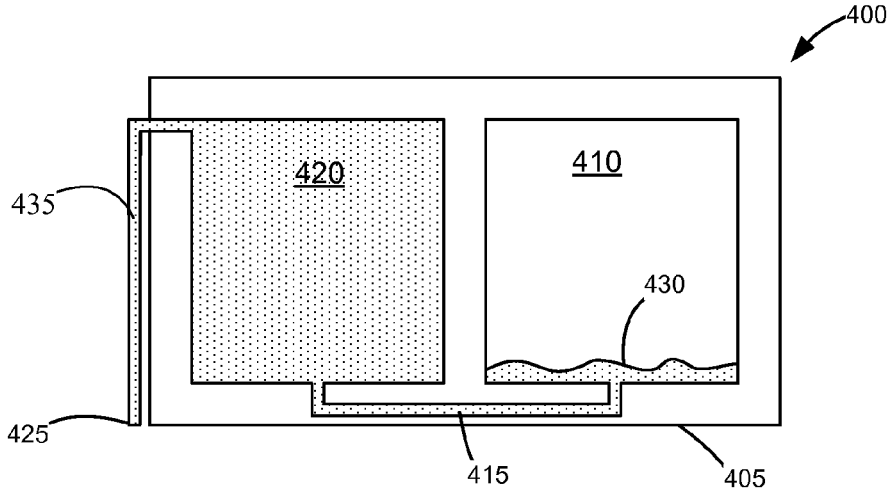

FIGS. 5A-5C illustrate the operation of lubricant dispenser 400 in dispensing lubricant oil 430. With respect to FIG. 5A, during a cool condition of heating element 208, e.g., without heating element 208 generating heat, lubricant oil 430 is largely contained in first chamber 410 while air occupies the space volume of second chamber 420. Upon heating reservoir 405 to the first temperature for performing a fusing operation, the air and lubricant oil 430 in reservoir 405 expand, moving lubricant oil 430 into second chamber 420 as illustrated in FIG. 5B. Lubricant oil 430 is retained in second chamber 420. Heating the reservoir 405 at this first temperature does not cause lubricant oil 430 to be dispensed from reservoir 405. However, when heating element 208 generates heat at the second temperature greater than the first (fusing) temperature, air and lubricant oil 430 expand further, causing lubricant oil 430 to flow from reservoir 405 through exit port 425, as illustrated in FIG. 5C. Lubricant oil 430 dispensed from reservoir 405 to exit port 425 is deposited onto the inner surface of moving member 210.

Upon cooling reservoir 405 from the second temperature, lubricant oil 430 contracts and flows back into reservoir 405 and air replaces the volume initially occupied by the dispensed lubricant oil 430. Further cooling the reservoir 405 to a temperature below the first temperature contracts the lubricant oil 430 substantially completely back into first chamber 410.

The amount of lubricant oil 430 dispensed by the lubricant dispenser 400, at a first instance the reservoir 405 is heated at the second, elevated temperature, may be determined by the following equation $$V_1=(V_a-V_L)(T+273.15)/(293.15)+V_L[(T-20)E+1]-V_a-V_b$$

wherein $V_1$ represents the volume of lubricant oil 430 dispensed during the first instance of lubricant dispensing; $V_a$ represents the space volume of first chamber 410; $V_b$ represents the space volume of second chamber 420; $V_L$ represents the initial volume of lubricant oil 430 in the reservoir 405; T represents the second temperature in degrees Celsius; and E represents the lubricant oil 430 expansion rate in 11° C.

During the second instance of heating reservoir 405 to the second, elevated temperature, the amount of lubricant dispensed by lubricant dispenser 400 may be determined by the following equation:

$$V_2=(V_a-V_L+V_1')(T+273.15)/(293.15)+(V_L-V_1')[(T-20)E+1]-V_a-V_b,$$

where $V_2$ represents the volume of lubricant oil 430 dispensed, and $V_1'$ may be represented by the equation $$V_1'=V_1/[(T-20)E+1]$$

After the first instance of lubricant oil dispensing, it can be shown that the amount of lubricant oil 430 dispensed during each instance n of heating the lubricant oil at the second temperature T may be generally represented by $$V_n=(V_a-V_L+V_{n-1}')(T+273.15)/(293.15)+(V_L-V_{n-1}')[(T-20)E+1]-V_a-V_b$$

where Vn is the volume of lubricant oil 430 dispensed during instance n and $$V_{n-1}'=V_{n-1}/[(T-20)E+1]$$

The above equations may be used to control the amount of lubricant oil dispensed from the lubricant dispenser during each desired lubricant oil dispensing operation.

Figure 6:
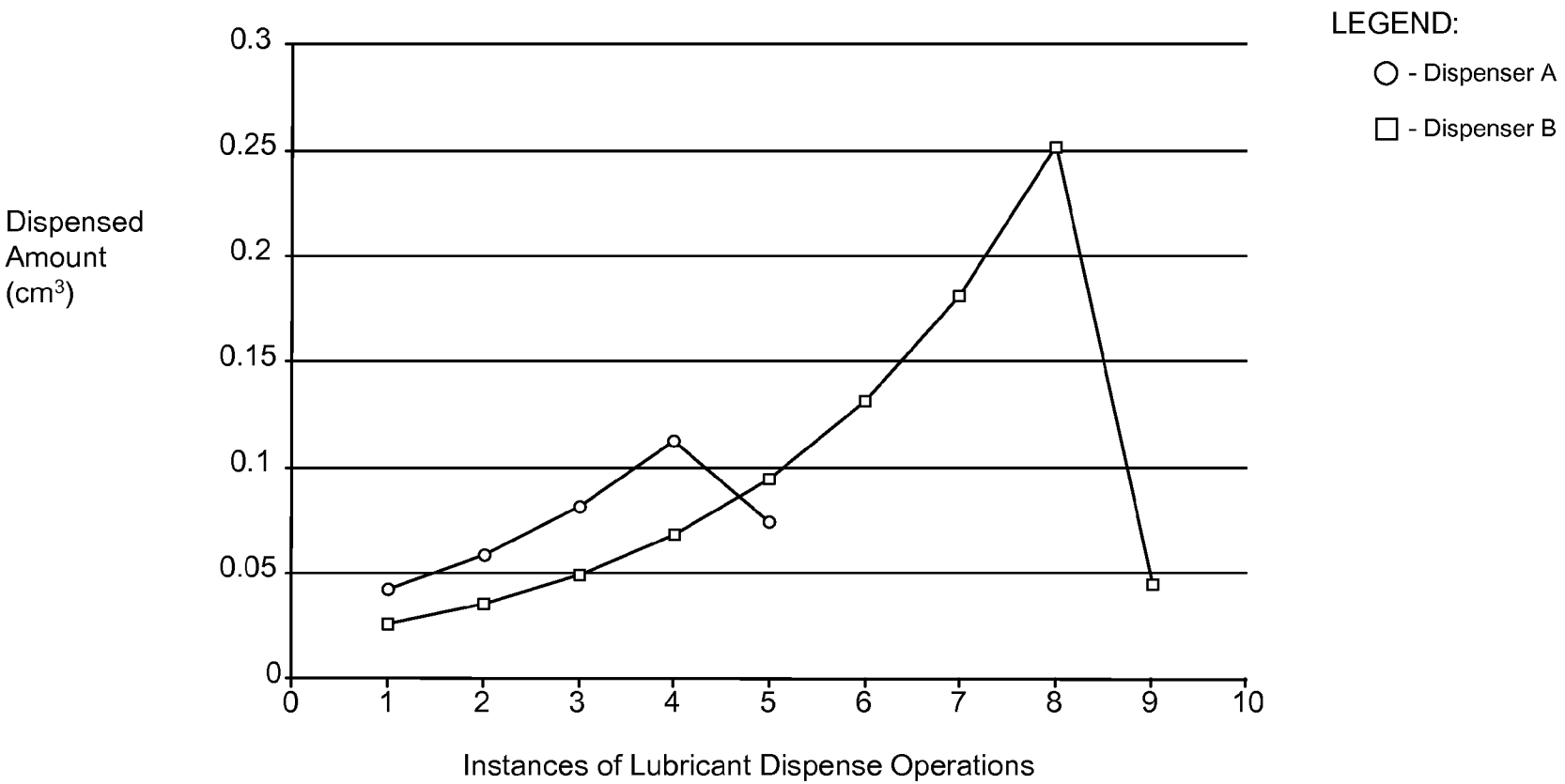
FIG. 6 is a graphical illustration of a dispense pattern of the lubricant dispenser according to an example embodiment.

The particular value of the second temperature may be adjusted at each lubricant oil dispensing operation in order for lubricant dispenser 400 to dispense a desired amount of lubricant oil 430. In one example embodiment, lubricant dispenser 400 may be heated by heating element 208 to substantially the same second temperature for each lubricant oil dispensing operation. In this scenario, the amount of lubricant oil 430 dispensed by lubricant dispenser 400 increases with each succeeding instance. FIG. 6 illustrates an example dispense pattern of lubricant dispensers A and B which are heated at the same second temperature in each dispense operation. The operating variables of the example lubricant dispensers A and B are presented in Table 1 below.

TABLE 1

| Lubricant Dispenser | $V_a$ (cm$^3$) | $V_b$ (cm$^3$) | $V_L$ (cm$^3$) | E (1/° C.) | T (° C.) |
|---|---|---|---|---|---|
| A | 2 | 0.73 | 1 | 0.000923 | 200 |
| B | 1 | 0.136 | 1 | 0.000923 | 200 |

As illustrated by the dispense pattern of lubricant dispensers A and B in FIG. 6, the amount of lubricant oil 430 dispensed increases in each succeeding lubricant dispensing operation. Heat was removed after each dispensing operation, which cools reservoir 405 and contracts lubricant oil 430 inside first chamber 410. The volume occupied by the dispensed lubricant oil 430 in first chamber 410 is replaced by air, increasing the amount of air inside first chamber 410. The expansion rate of air is much greater than the expansion rate of lubricant oil 430. As a result, in each succeeding dispense operation, there is greater expansion, resulting in a greater amount of lubricant oil 430 dispensed from reservoir 405. This increasing dispense pattern of lubricant oil 430 continues until first chamber 410 of reservoir 405 is largely depleted of lubricant oil 430. With respect to FIG. 6, the drop-off of the dispensed lubricant oil 430 in the last dispense operation indicates the depletion of lubricant oil 430 inside reservoir 405.

In another example embodiment, lubricant dispenser 400 is heated to dispense substantially equal amounts of lubricant oil 430 during each of the lubricant oil dispensing operations. The second temperature is varied, and in particular lessened, during each successive lubricant oil dispensing operation. A predetermined series of second temperature values to be used during the lubricant oil dispensing operations may be determined based on the above equations to result in lubricant dispenser 400 dispensing substantially equal amounts during each dispensing operation over the life of moving member 210.

Figure 7:
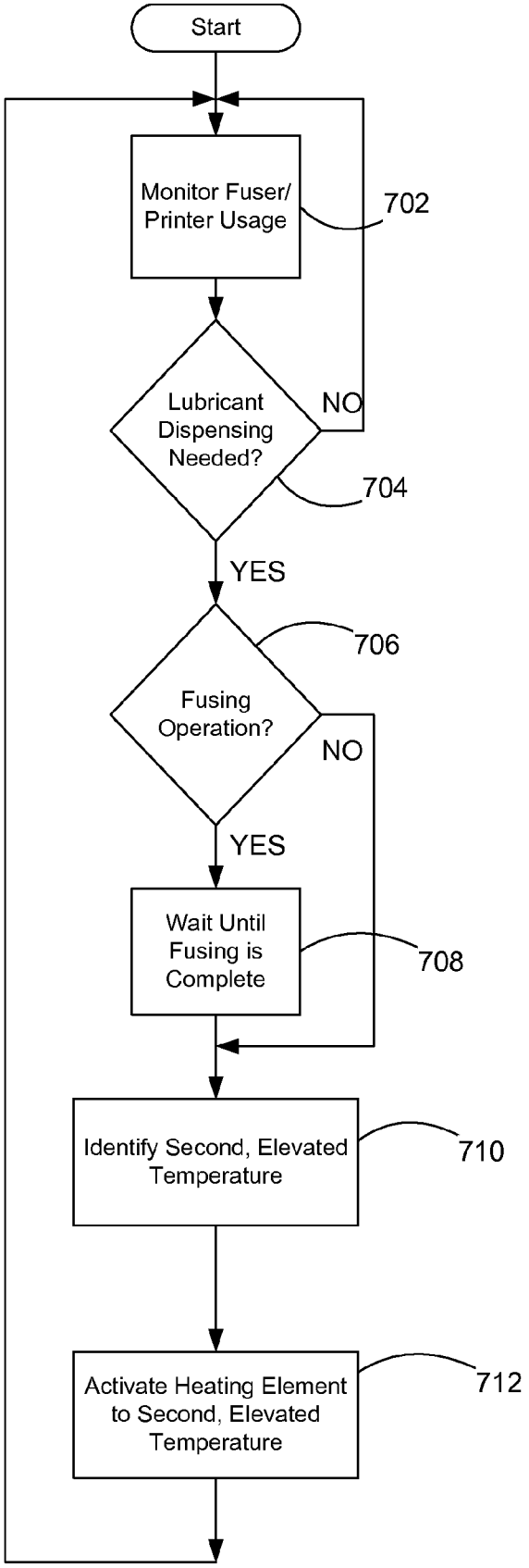
FIG. 7 is a flowchart illustrating a method of controlling the lubricant dispenser in the imaging device.

In imaging device 100, the lubricant dispenser 400 may be controlled by controller 102, via control of heating element 208, to automatically dispense the lubricant oil 430 based on the usage of the fuser assembly 200. FIG. 7 illustrates the method of controlling lubricant dispenser 400 in imaging device 100.

Fuser assembly 200 and/or imaging device 100 usage may be monitored at 702 using a variety of techniques, such as monitoring printed page count, monitoring the number of rotations of backup roll 204, etc., following which a determination is made by controller 102 at 704 whether a lubricant oil dispensing operation is to be performed. An affirmative determination may occur, for example, if the printed page count since the last lubricant oil dispensing operation reaches a predetermined page count value, the number of rotations of backup roll 204 since the last lubricant oil dispensing operation reaches a predetermined number of rotations, etc. Acts 706 and 708 are employed in order to ensure that a lubricant oil dispensing operation is not performed during a fusing operation.

Once it is determined that a lubricant oil dispensing operation is to occur, the second temperature value is identified by controller 102 at 710. As discussed above, the second temperature value may be the same for each lubricant oil dispensing operation or it may vary depending upon the amount of lubricant oil desired to be dispensed. For example, decreasing the second temperature value with each successive lubricant oil dispensing operation may result in lubricant dispenser 400 dispensing substantially the same amount of lubricant oil during each operation. In an example embodiment, memory 103 maintains at least one table of second temperature values which controller 102 sequentially accesses at the time of each lubricant oil dispensing operation in order to determine the second temperature value to use therein. In another embodiment, controller 102 may calculate the second temperature value for a single lubricant oil dispensing operation based upon, for example, at least one of the second temperature value used in an immediately preceding lubricant oil dispensing operation, one or more environmental conditions of imaging device 100, and one or more operating characteristics of fuser assembly 200 and/or imaging device 100. Thereafter, heating element 208 is activated by controller 102 at 712 to generate heat at the identified second temperature to cause lubricant oil dispensing to occur as desired.

As mentioned, controller 102 may be implemented using one or more processors. In an example embodiment, one such processor of controller 102, as well as memory coupled thereto, may be mounted and/or physically connected to fuser assembly 200. The processor may generally control the operation of fuser assembly 200, including activating heating element 208 to generate heat for performing fusing operations and lubricant dispensing operations.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An apparatus, comprising:

a fuser assembly, comprising:

a heating element;

a flexible belt rotatable about the heating element, an inner surface of the flexible belt contacting the heating element; and a lubricant dispenser disposed in proximity with the heating element for dispensing at least one lubricant component to the flexible belt, the lubricant dispenser including a reservoir containing the at least one lubricant component, and an exit port for delivering the at least one lubricant component from the reservoir to the inner surface of the flexible belt; and a controller coupled to the heating element for activating the heating element to generate heat at a fusing temperature during a fusing operation and at at least one second temperature greater than the fusing temperature during at least one lubricant dispensing operation so as to cause the at least one lubricant component to dispense from the lubricant dispenser, wherein there is no lubricant dispensing operation upon activating the heating element to generate heat at the fusing temperature.

2. The apparatus of claim 1, wherein the controller is mounted to or within the fuser assembly.

3. The apparatus of claim 1, wherein the controller monitors at least one operating characteristic of at least one of the apparatus and the fuser assembly, compares the at least one operating characteristic monitored with a predetermined value, and determines whether one of the at least one lubricant dispensing operations is to be performed based upon the comparison.

4. The apparatus of claim 3, wherein the at least one operating characteristic comprises pages of media sheets printed by the apparatus.

5. The apparatus of claim 1, wherein the controller selectively activates the heating element to generate heat at the at least one second temperature to perform a plurality of discrete lubricant dispensing operations during a lifetime of the flexible belt.

6. The apparatus of claim 5, wherein during each lubricant dispensing operation, the controller activates the heating element to generate heat at a third temperature value that is less than a second temperature value at which the heating element generated heat in an immediately preceding lubricant dispensing operation.

7. The apparatus of claim 5, wherein during each lubricant dispensing operation, the controller activates the heating element to generate heat at a third temperature value that is determined by the controller based upon a second temperature value at which the heating element generated heat in an immediately preceding lubricant dispensing operation.

8. The apparatus of claim 5, further comprising memory communicatively coupled to the controller, wherein for each lubricant dispensing operation, the controller determines the second temperature at which the heating element is to generate heat based at least upon accessing a table of temperature values in the memory.

9. The apparatus of claim 1, wherein the at least one lubricant component is only dispensed onto the inner surface of the flexible belt upon activating the heating element at the at least one second temperature.

10. A method of operating a fuser assembly, comprising:

providing a belt fuser assembly having a flexible belt, a heater element in contact with an inner surface of the flexible belt, and a lubricant dispenser positioned in proximity to the heater element, the lubricant dispenser containing at least one lubricant component therein for selectively dispensing the at least one lubricant component to the inner surface of the flexible belt;

selectively activating the heater element to generate heat at a first temperature during fusing operations;

selectively activating the heater element to generate heat at at least one second temperature greater than the first temperature to cause the lubricant dispenser to dispense the at least one lubricant component onto the inner surface of the flexible belt; and dispensing the at least one lubricant component onto the inner surface of the flexible belt only upon selectively activating the heater element at the at least one second temperature.

11. The method of claim 10, further comprising monitoring an operating characteristic of at least one of the fuser assembly and an apparatus in which the fuser assembly is located, and comparing the operating characteristic monitored with a predetermined value, wherein the heater element is selectively activated based upon the comparison.

12. The method of claim 11, wherein monitoring the operating characteristic comprises monitoring the operating characteristic since a last instance in which the at least one lubricant component was dispensed from the lubricant dispenser.

13. The method of claim 11, wherein the operating characteristic comprises pages of media sheets printed.

14. The method of claim 10, further comprising repeating the selectively activating the heater element to generate heat at the at least one second temperature a plurality of discrete instances during a lifetime of the flexible belt.

15. The method of claim 14, wherein during each instance in which the heater element is activated to generate heat at the at least one second temperature, the temperature is less than the temperature at which the heater element generated heat in an immediately preceding instance.

16. The method of claim 15, wherein substantially the same amount of the at least one lubricant component is dispensed from the lubricant dispenser during each instance in which the heater element is activated to generate heat at the at least one second temperature.

17. The method of claim 14, wherein the heater element is activated to generate heat at the same temperature during the instances in which the heater element is activated to generate heat at the at least one second temperature.

18. The method of claim 10, further comprising prior to selectively activating the heater element to generate heat at the at least one second temperature, identifying the at least one second temperature.

19. The method of claim 18, wherein identifying the at least one second temperature comprises accessing a temperature value from a table stored in memory.

20. The method of claim 18, wherein identifying the at least one second temperature comprises calculating the at least one second temperature from a second temperature used in an immediately preceding instance in which the at least one lubricant component is dispensed from the lubricant dispenser.

* * * * *